US005967132A

United States Patent [19]

Loomis

[11] Patent Number: 5,967,132

[45] Date of Patent: Oct. 19, 1999

[54] COMPOUND BOW

[75] Inventor: L. Rodger Loomis, Fulton, N.Y.

[73] Assignee: Lakewood Acquisitions, Fulton, N.Y.

[21] Appl. No.: 09/085,436

[22] Filed: May 27, 1998

Related U.S. Application Data

[63] Continuation-in-part of application No. 08/900,619, Jul. 25, 1997.

[51] Int. Cl.[6] ..... F41B 5/10

[52] U.S. Cl. ..... 124/25.6

[58] Field of Search ..... 124/23.1, 25.6, 124/86, 88

[56] References Cited

U.S. PATENT DOCUMENTS

| | | | |
|---|---|---|---|
| 3,981,290 | 9/1976 | Islas | 124/25.6 |
| 4,287,867 | 9/1981 | Islas | 124/25.6 |
| 4,781,168 | 11/1988 | Lester | 124/25.6 |
| 4,858,588 | 8/1989 | Bozek | 124/23.1 |
| 5,205,267 | 4/1993 | Burdick | 124/86 X |
| 5,388,564 | 2/1995 | Islas | 124/25.6 |
| 5,687,703 | 11/1997 | Vyprachticky | 124/25.6 |

*Primary Examiner*—John A. Ricci
*Attorney, Agent, or Firm*—Wall Marjama Bilinski & Burr

[57] ABSTRACT

A compound bow includes a riser section, a pair of inner bow limbs cantilevered to respective ends of the riser section, and a pair of outer bow limbs each hingably attached the free standing end of the inner bow limbs. A cam assembly includes a pair of parallel cams attached to opposite sides of the riser section for allowing a pair of camming cables to extend over the edges of the hinged limbs. Each pair of parallel cams are disposed outboard of the width of the riser section to interconnect the bow limbs for lessening the pull force as the drawstring is pulled beyond an intermediate draw length. In a preferred arrangement, the camming cables each extend of the edge of the outer bow limb, and are spaced on either side of the hinged connection between the bow limbs.

10 Claims, 7 Drawing Sheets

COMPOUND BOW

CROSS REFERENCE TO OTHER-RELATED APPLICATIONS

This application is a continuation-in-part application of U.S. patent application Ser. No. 08/900,619, filed Jul. 25, 1997.

FIELD OF THE INVENTION

This invention relates to archery bows, and more specifically to a compound archery bow having an improved cam assembly for lessening the force required to pull the drawstring at an intermediate draw point.

BACKGROUND OF THE INVENTION

For purposes of control and accuracy, it is desirable that a less than maximum draw force be perceived by an archer when the bowstring has been pulled taut. To that end, a number of bow designs utilize cams suspended between the bow limbs to control the relative motion between the bow string and the bow limbs such that maximum pull is reached at an intermediate draw position. Such designs are described in U.S. Pat. Nos. 3,981,290, 4,287,867, and 5,388,569. In the U.S. Pat. No. '569 patent, a cam assembly is disposed adjacent the interconnection of the outer and power limbs, and interconnected to the riser using a pair of corresponding pulleys.

A more specific compound bow design designed and manufactured by Oneida Labs of Fulton, N.Y., is illustrated in FIGS. 2 and 3. The bow 10A includes a riser portion 12A having a pair of outer limbs 54, each limb being hingably attached to the distal end of a respective power limb 38. The opposite or proximal end of each power limb 38 is attached to the end of the riser portion 12A. A drawstring 74 extends between the distal ends of the outer limbs 54.

More specifically, a single cam 156 is centrally mounted to an axle disposed between a pair of mounted parallel extension plates 140, 144 at the top and bottom of the riser portion 12A, the plates being directly attached by fasteners thereto. A pair of cables 110, 120 extend from each cam 156, one of the cables 110 being interconnected with the outer limb 54 to rotate the mounted cam in response to pulling of the drawstring 74. As the cam 156 rotates past its knockover point, the tension in the drawstring as perceived by the archer is significantly reduced, thereby allowing a level of accuracy and control at the time most needed.

The remaining cable 120 interconnects each cam 156 with each flexible power limb 38 to bias and return the cam to its original prefiring position after the tension of the drawstring 74 has been removed, using the hinged arrangement between the outer limb 54 and the power limb.

In the described bow design, the plates 140, 144 must extend a considerable distance in order to allow the mounted cam 156 to successfully rotate. In addition, because the cam 156 is centrally disposed between the two plates 140, 144, an intermediate yoke 130 is required to allow interconnection of the first cable 110 from the internal grooves of the cam 156 over the edges of the outer limb 54. Similarly, a clevis block 160 is also required to interconnect the remaining cam cable 120 to the power limb 38.

Each of the above components introduce a level of structural complexity, as well as add weight to the above described bow. For example, the use of the intermediate yoke constrains the sizing of the bow, preventing the manufacture of bows for younger users. It is a perceived desire in the industry to be able to construct and manufacture a compound bow including a cam assembly for lessening the draw force, but which optimizes weight, size and manufacturability.

SUMMARY OF THE INVENTION

It is a primary object of the present invention to improve the state of the art of archery bows.

It is a further object of the present invention to provide a compound archery bow which is lighter and easier to use than those currently known.

It is a further object of the present invention to provide a compound bow having a cam assembly to take up the draw force at an intermediate pull position of the drawstring, while making the bow as light and simple to manufacture as possible.

Therefore, and according to a preferred aspect of the present invention, there is provided A compound archery bow, comprising:

a riser section having a center portion and a pair of opposing ends;

a pair of flexible inner bow limbs, each of said inner bow limbs being cantilevered to a respective end of said riser section;

a pair of outer bow limbs, each of said outer bow limbs being hingably attached at an intermediate portion thereof to free standing ends of a corresponding inner bow limb;

a drawstring tautly attached at each end thereof to respective distal ends of said pair of outer bow limbs; and a cam assembly including two pairs of parallel cams, each pair of parallel cams being oppositely disposed relative to the center portion of said riser section and oppositely spaced outboard of the width thereof, and first and second camming cables associated with each said pair of parallel cams, each of said first and second camming cables extending along respective spaced paths extending between a pair of parallel cams and the width of one of said inner and outer bow limbs, wherein pulling of said drawstring causes coordinated rotation of said cams so as to cause lessening of the tension of said drawstring at an intermediate draw point.

Preferably, the camming cables are each disposed over the width of their respective bow limbs, and are aligned with the parallel cams. More preferably, the cams are provided on an integral portion of the riser and can be oversized to allow multiple reeving points, with the cams being outboard of the riser and being accessible, it is also preferred the reeving points be disposed on the exterior of the cams.

The camming cables extend along defined paths between a single pair of parallel cams and extend along a path which covers the width of the outer bow limb and either the inner or outer bow limb, respectively. In a preferred embodiment, each of the camming cables extend over the width of the outer bow limb, the cables being spaced on either side of the hinge assembly.

An advantage of the present invention is that by placing the parallel cams outboard of the riser, the cams can freely pivot without interfering with the construction of the riser. Therefore, the distance between the riser and the drawstring can be effectively reduced, providing a larger power stroke, and the potential for storing energy and generating speed.

Another advantage of the present invention is that directly attaching the cams integrally with the riser section provides a compound bow design which is simpler and cheaper to manufacture than current bows of a similar type.

Yet another advantage of the present invention is that positioning twin spaced cams in direct alignment with the edges of the bow limbs removes any need for having a riser with extending pylons as previously required to allow sufficient room for the cam to rotate. Removal of the pylons, therefore, provides a considerable reduction in weight as well as elimination of vibration noise, necessarily making the bow easier to use, and also eliminates residual costs, such as manufacturing, assembly, coating and painting thereof.

Advantages are also provided by splitting the cam assembly in that the cable grooves of the cams are better aligned with the outside edge of the limbs, allowing elimination of the yoke of the above described prior art bow. The yoke of the instant bow was required to route the cable from the outside edges of the outer limbs back to the center of the cam as mounted between the extension plates.

Further benefits are realized because the cams can be built to a larger size without impacting the size (e.g. the height) of the riser section. With larger cams, camming cables can be reeved to the accessible exterior surface of the cams, increasing serviceability and improving assembly time. Another advantage provided by allowing the cables to be reeved to the cam exteriors is that the cables can be reconfigured, if desired, into optional paths which provide user definable draw lengths and/or letting off percentages without the use of current inserts which are inherently more complex.

Splitting of the cam further eliminates the need for the above clevis block from the preceding compound bow design, further reducing strain on fasteners connecting the hinge assembly through the power limb to the clevis. Furthermore, and by running the cable above the limb (as the cam cable does over the width of the limb) the small loop previously created in the power cable is avoided, thereby increasing cable life.

Rerouting the power cable over the power limb in the described manner also aids in limb alignment by allowing side to side slippage in the cable upon installation and securing, such as using a set screw, as is currently done with the yoke cable.

Similar pronounced benefits are provided in that by splitting the cam, the forward edge of the synchronization timing wheel can be aligned with the timing cable groove, thereby eliminating the need for a pair of timing idler wheels, as used in commonly known compound bows. The overall diameter of the cam can be increased without causing rotational interference with riser or forcing the cam axle further away from the riser.

Still further, manufacturing a larger cam also provides more programming surface which makes the effects of small changes less important, meaning that less precision is needed in manufacture and design. In summary, the above described compound bow herein includes relatively large savings in weight as compared with existing bow designs, e.g. 6 to 10 ounces or more, greater design flexibility, improved assembly time, reduced numbers of active components required to construct the bow, increases in camming and timing cable life, and improved stability and alignment in the bow limbs, less vibration noise, and improved aesthetics.

These and other objects, features, and advantages are herein described with reference to the following Detailed Description of the Invention which should be read in conjunction with the following drawings.

DETAILED DESCRIPTION OF THE INVENTION

The following description refers primarily to a specific embodiment of a compound bow in accordance with the present invention. Throughout the course of discussion, terms such as "front", "rear", "upper", "lower", "top", "bottom", and the like are used to more clearly describe the embodiment through the illustrations provided in FIGS. 1–8, herein. It should be noted that these terms are provided merely as a frame of reference and are not intended to be limiting as to the present invention.

Figure 1:
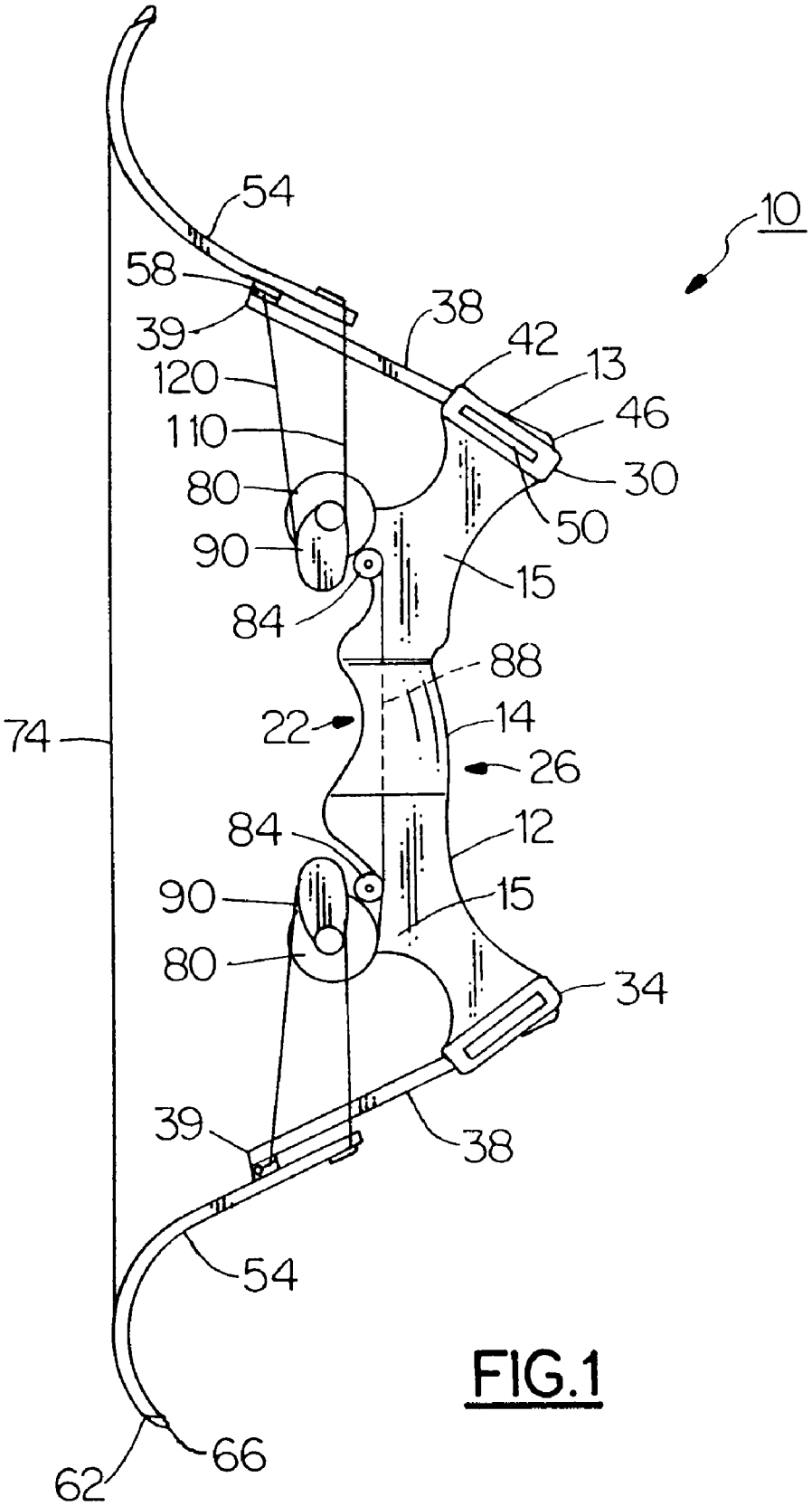
FIG. 1 is a side elevational view of a compound bow made in accordance with a preferred embodiment of the present invention.

Referring now to the Figs. and specifically to FIG. 1, there is shown a side elevational view of a compound bow 10 in accordance with a first embodiment, having a riser or central section 12 including a hand grip 14 therein and a flat rest (not shown) for receiving an arrow (not shown) therein. The riser 12 includes a belly side 22 which directly faces the archer when he or she is holding the bow 10 in the firing position (as perceived on the left side in this view) with the opposite back side 26 of the riser section facing the target (as perceived on the right side according to this view). The riser section 12 is preferably made from aluminum or magnesium and includes respective top and bottom end portions 30, 34. Alternately, the riser section 12 can also be made using any suitable material having sufficient rigidity and strength. More recently, risers for example, can be manufactured using CNC processing.

A pair of identical spring members (referred to hereinafter as power limbs 38) are cantilevered from the top and bottom end portions 30, 34 of the riser 12. The base 42 of each power limb 38 is securely attached by any suitable means within a complimentary limb pocket 50 formed therein. In assembly, each power limb 38 extends outwardly and inwardly so that the limb leans toward the belly side 22 of the riser 12. The power limb 38 may be fabricated from any suitable spring-like material in either a single layer or multiple layers. A weight adjustment screw 46 attached to the front face 13 of the riser section 12, or other suitable means, may be operatively associated with each power limb 38 to permit the spring response thereof to be varied.

Figure 4:
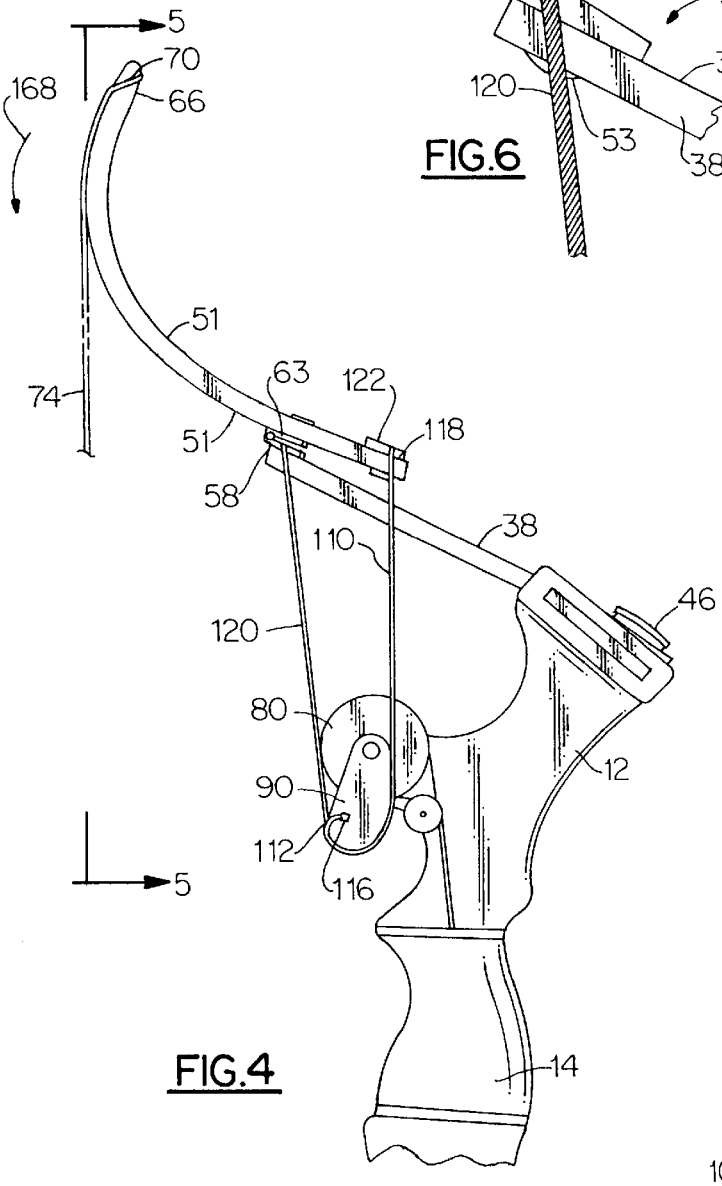
FIG. 4 is an enlarged partial side elevational view of the bow of FIG. 1.

The free end 39 of each power limb 38 is hingably secured to a companion outer bow limb 54 at an intermediate position thereof using a hinge assembly 58. Each outer limb 54 is a curved member made from a flexible material, such as fiberglass, that contains a tip 62 at its distal end 66 in which a string nock 70, FIG. 4, is formed for operatively receiving one end of a draw or bow string 74. The outer bow limb 54 is more rigid than the flexible power limb 38 and is constructed of wood composites which may or may not contain fiberglass or any other suitable material, as is known and used in the art.

Synchronization of the limb action of the instant bow 10 must act in unison to insure constant accuracy and repeatability. Therefore, a pulley and cable system is provided including a synchronizing pulley 80, which is disposed on a reflexed portion 15 on either side of the riser section 12 having a idler wheel 84 or wheel disposed proximate thereto. An endless timing cable 88 is disposed over cable grooves (not shown) provided on each synchronization pulley 80 and interconnected through the center of the riser section 12 within a longitudinal conduit (not shown) in a manner which is known to skill in the art. A suitable arrangement is described in greater detail in U.S. Pat. No. 4,287,867, incorporated by reference herein. The described synchronization system is contained substantially within the riser 12 of the bow 10, thereby adding to the aesthetic value of the bow, as well as preventing the component parts thereof from becoming entangled with foreign objects or the like.

Figure 6:
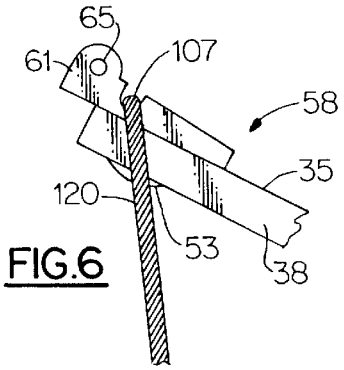
FIG. 6 is a partial side view of the hinge assembly of the compound bow of FIGS. 1 and 4–5.
Figure 5:
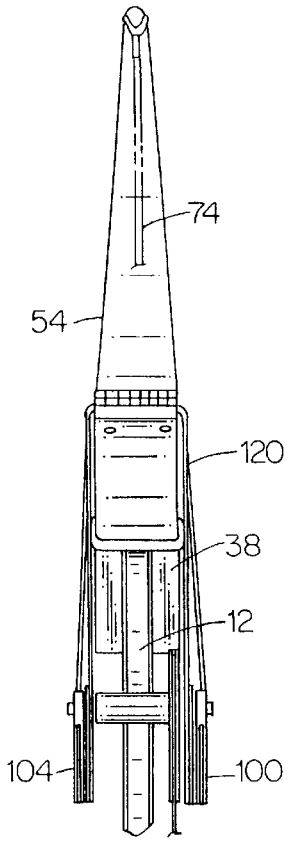
FIG. 5 is a partial end view of the compound bow as taken through the lines 5—5 of FIG. 4.

As noted above, each of the outer limbs 54 are respectively interconnected to the power limbs 38 by means of a hinge assembly 58. Referring to FIGS. 1, 4 and 6, the hinge assembly 58 according to this embodiment includes a pair of hinge plates 61, 63 connected together by a common hinge pin 65 at one end thereof. The hinge plates 61, 63 are respectively attached to the front side 35 of the power limb 38 and the back side 51 of the outer bow limb 54, each plate being fixedly attached thereto using threaded fasteners 53 or other suitable means. As noted, the free end 39 of each power limb 38 is aligned with the outer bow limb 54 at an intermediate position, the hinge assembly 58 being located at this aligned location.

Figure 7:
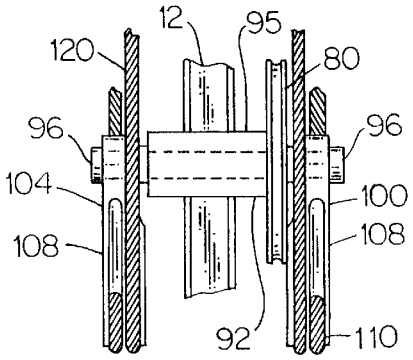
FIG. 7 is an enlarged view of the cam assembly illustrated in FIG. 5.
Figure 8:
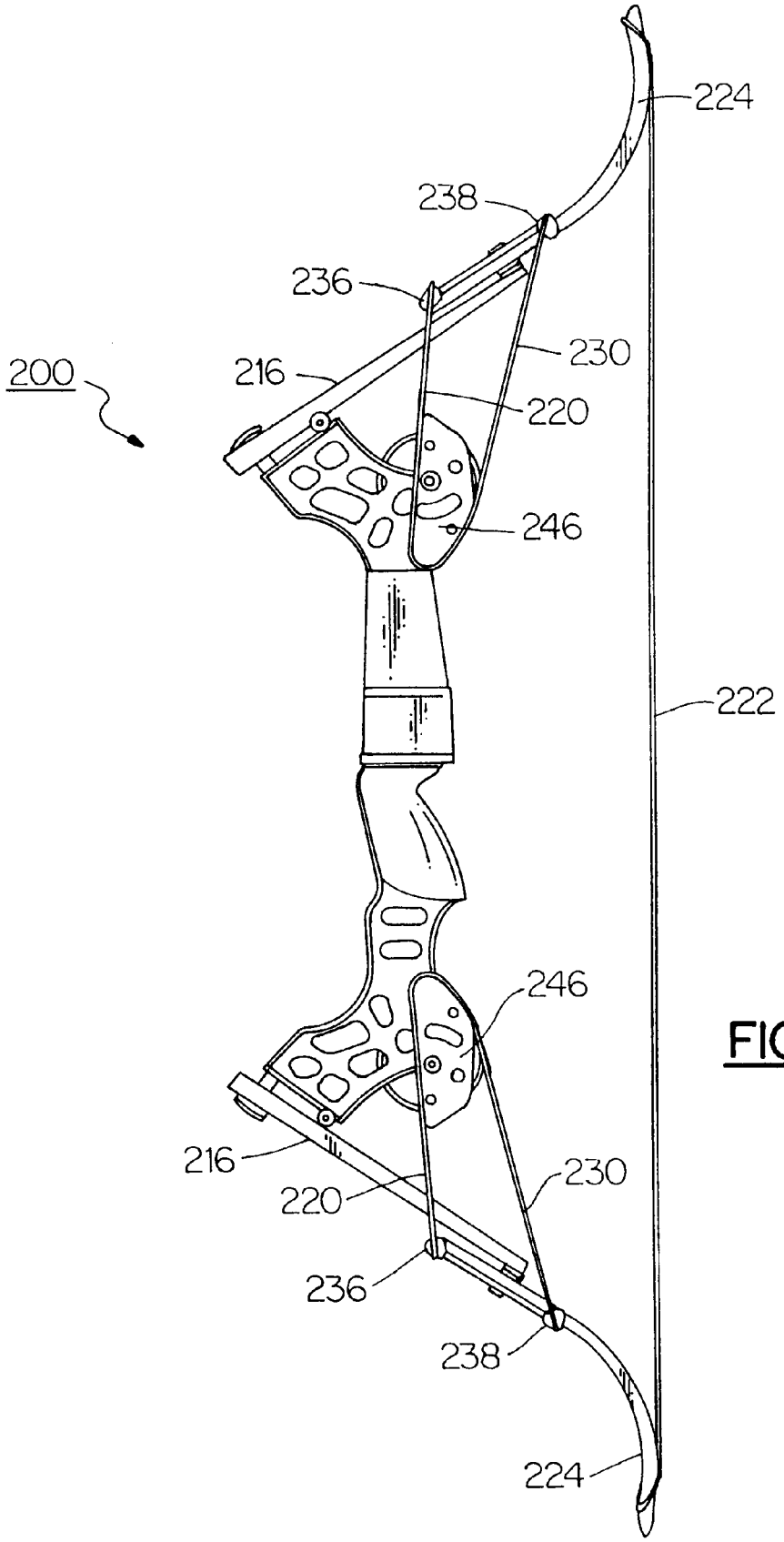
FIG. 8 is a side elevational view of a compound bow made in accordance with a second embodiment of the present invention.
Figure 9:
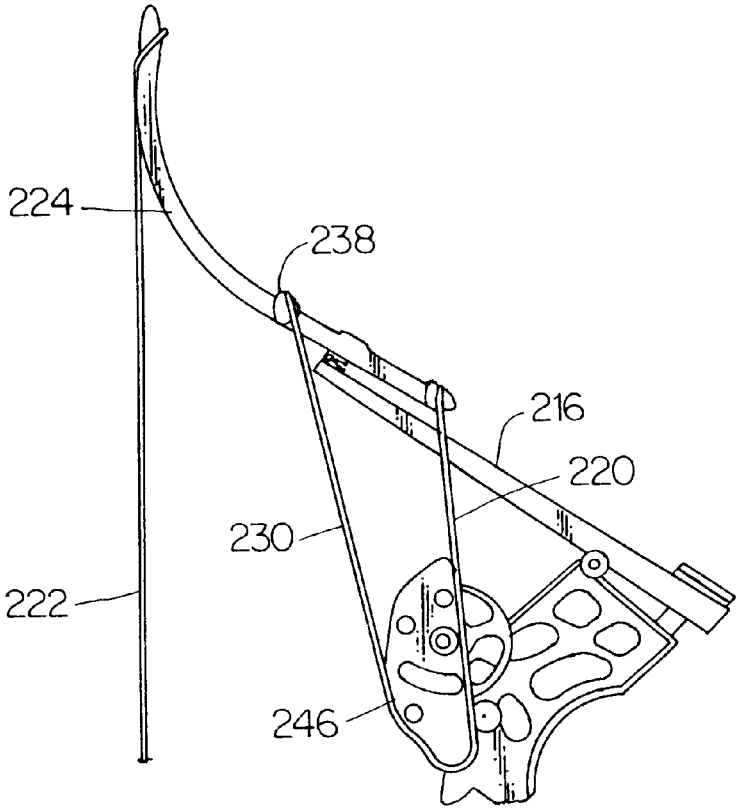
FIG. 9 is a partial side elevational view of the compound bow of FIG. 8.

Referring to FIGS. 1 and 4–7, a center stanchion 92, FIG. 7, includes an axle 95 having a pair of ends 96 extending from a reflexed portion 15 of the riser section 12, the axle extending across the entire width of the riser. A cam assembly 90 including a pair of eccentric cams 100, 104 are mounted in parallel and coaxial relation to the axle 95 at either end 96 thereof and beyond the defined width of the riser section 12 as perceived from the belly side 22 of the bow 10. That is to say, each cam 100, 104 is outboard of the riser section 12 such that the rotation of the cams is not impeded.

The cams 100, 104 are separately mounted to each end 96 of the center stanchion 92 using suitable threaded fasteners, each cam having parallel peripheral grooves, more specifically a pair of inboard and a pair of outboard grooves 106, 108, respectively, for retaining interconnecting cables as described in greater detail below.

Still referring to FIGS. 1 and 4–7, a first camming cable, hereinafter referred to as the cam cable 110, is attached/reeved at one end of one of the cams 100 using a end cable sleeve 112 fitted in an exterior radial slot 116. The cam cable 110, wound around the bottom of the cam 100 using the outboard groove 108, extends therefrom to the end of the outer limb 54. The cable 110 is guided through a V-shaped groove 118 extending across the width of the limb in a saddle 122 attached to the front face 51 of the outer limb 54 at the interior end thereof. The cam cable 110 extends to the opposite side of the bow 10 and into the outboard groove 108 of the remaining cam 104. The cable 110 is reeved at its remaining end on the opposite end of the cam, e.g. the side directly facing the drawstring 74, as most clearly illustrated in the enlarged FIG. 7.

One end of the second camming cable, hereinafter referred to as the power cable 120, is reeved at an interior side of the cam 100 and extends through the inboard groove 106 to the top face 35 of the power limb 38 where the cable is guided through a groove 107 provided in the hinge plate 61, see FIG. 6, and extending over the entire width of the limb. The cable 120 is directed over the inboard groove 106 of the parallel cam 104, the remaining end of the power cable 120 being reeved in an interior slot (not shown) thereof. The synchronizing pulley 80 is secured using fasteners or other suitable means to the interior side of the cam 104.

Figure 2:
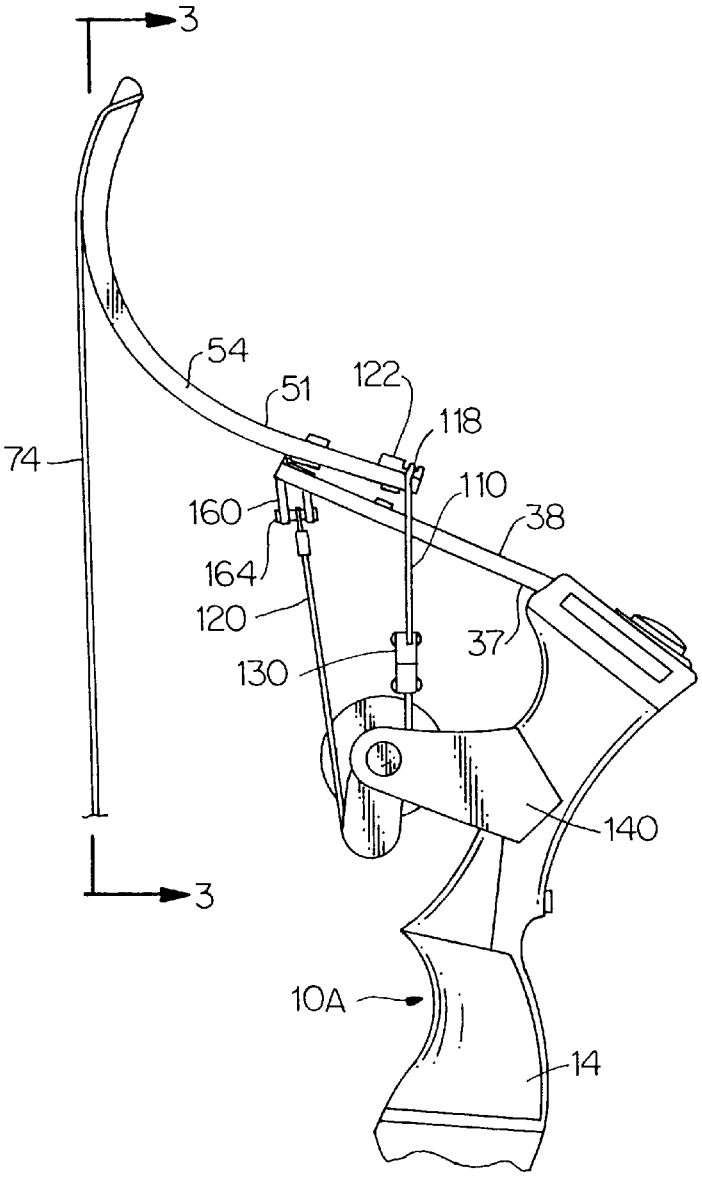
FIG.2 Prior Art
FIG. 2 is a partial end view of a compound bow in accordance with the prior art.
Figure 3:
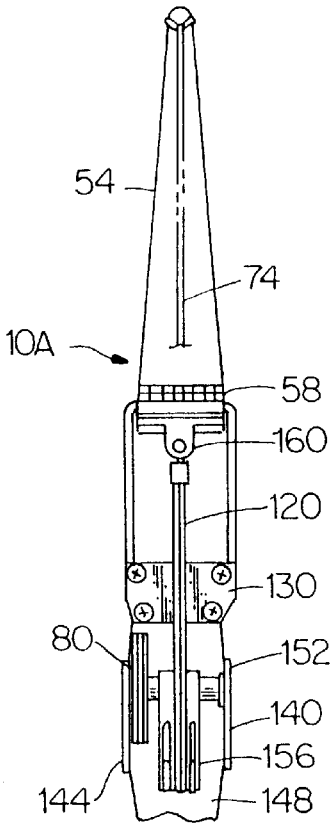
FIG.3 Prior Art
FIG. 3 is an enlarged partial side elevational view of the bow of FIG. 2, illustrating a cam system utilized in the prior art.

In order to better distinguish the presently described invention, it is believed helpful at this juncture to consider and compare the operation of the presently described bow design with that previously referred to in FIGS. 2 and 3. Note that similar parts have been labeled with the same reference numerals for the sake of clarity.

Briefly, the bow 10A includes a riser section 12A similar in construction to that previously described, as well as a pair of power limbs 38, and a pair of outer limbs 54 also attached as previously described. For simplicity, only one side of the bow 10A is illustrated and described herein, though it will be apparent that the remaining side of the bow performs in an identical manner.

Each of the power limbs 38 are attached to the outer bow limbs 54 by means of a hinge assembly 58, also as previously described, with the free end 39 of the power limb 38 being attached at an intermediate portion.

As previously noted, the bow 10A does not include a reflexed portion, but rather incorporates a pair of thin metal pylon plates 140, 144 which are attached at one end by suitable means, such as threaded fasteners to the riser portion 12, at a position between the hand grip 14 and the top end portion 30. The plates 140, 144 extend from the belly side 22 to define a cavity 148 therebetween. An axle 152 mounted at the unsupported end of the plates 140, 144 supports a single cam 156. The cavity 148 is sufficient in height to allow the cam 156 to travel in a rotary path as detailed below.

A clevis block 160 including a pin 164 is positioned on the back side 37 of the power limb 38 for supporting one end loop of a power cable 120. The remaining end of the cable 120 is reeved to the cam 156 as shown in FIG. 3.

The power cable 120 interconnects the end of the cantilevered outer bow limb 54 to the cam 156. Respective ends of the power cable 120 is reeved to the cam 156 and is guided along an outboard cam groove 108 through the yoke 130 and across the front side 51 of the outer limb 54 through a V-shaped groove 118 on the saddle 122 attached to the outer limb 54, using threaded fasteners or the like. As is clear from FIG. 3, the yoke 130 allows the cable 120 to extend to the edges of the limb 54.

In operation, the drawstring 74 is pulled which flexes the distal end 66 of the rigid outer limb 54 in a counterclockwise direction shown by the reference numeral 168. The flexion of the outer limb 54 causes the limb to pivot about the hinge assembly 58 and causes a pulling action of the power cable 120, causing rotation of the cam 156. As the cam 156 rotates, the power limb 38 is also flexed inwardly due to the rotation of the cam and the interconnection of the cam cable 120, providing a tensioning force. As the cam 156 continues to rotate as the bowstring 74 is pulled, the cam will pass its knockover point, the amount of draw force required by the archer is subsequently lessened in the manner described in U.S. Pat. No. 5,388,569, the contents of which are hereby incorporated in their entirety by reference.

The release of the drawstring 74 removes the force on the end of the outer limb 54 and the cam cable 110 under compression from the hinge assembly 58 restoring the cam 156 to its original prefiring position.

Comparing the operation of the two bows, and referring generally to FIGS. 1 and 4–7., the pulling of the drawstring 74 causes the outer limb 28 of the present embodiment to be flexed as shown, causing respective clockwise rotation of the cams 100, 104 due to the pulling action of the outer limb 54 and the hinge assembly 58. The rotation of the cams 100, 104 continues as the bowstring 74 is pulled until the cams have reached their knockover point at which the tension on the drawstring is eased allowing the maximum pull weight to be reached without significant additional effort on the part of the archer.

Upon release of the drawstring, the cams 100, 104 are restored to their original position due to the tensioning of the camming or power cable 120 as the outer limb 54 is pulled due to the biasing force supplied by the hinge assembly 58. Therefore, the operation of each bow provides a cam assembly which allows a lessening of draw force, the presently described bow, however, deleting the need for the yoke, and allowing the power cable 120 to be more reliably secured to the hinge assembly 68 in that the cams 100, 104 are spaced at a distance which aligns the pairs of camming cables 110, 120 directly with the edges of the bow limbs 38, 54.

Figure 10:
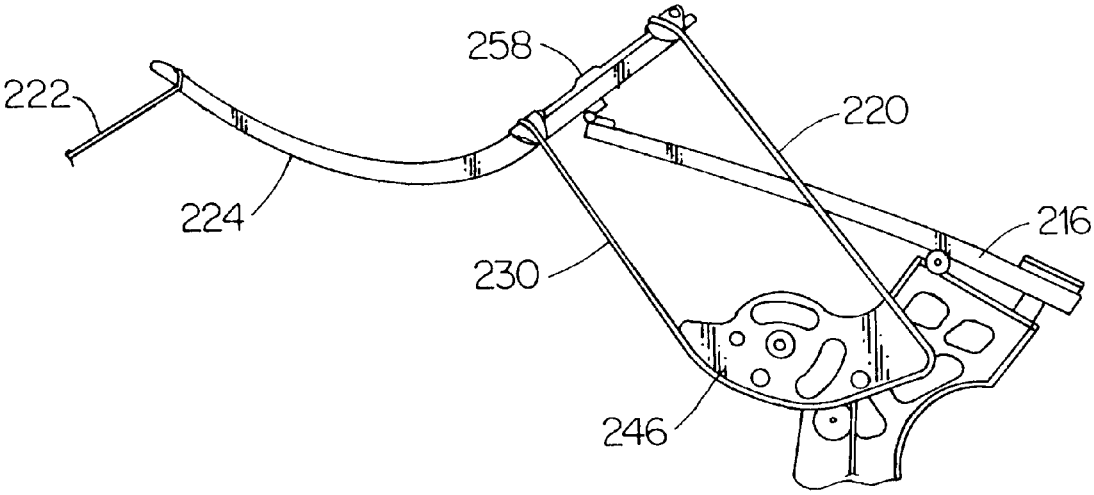
FIG. 10 is the partial side elevational view of the compound bow of FIG. 9, showing the positioning of the respective limbs and cam assembly as the drawstring is pulled.
Figure 11:
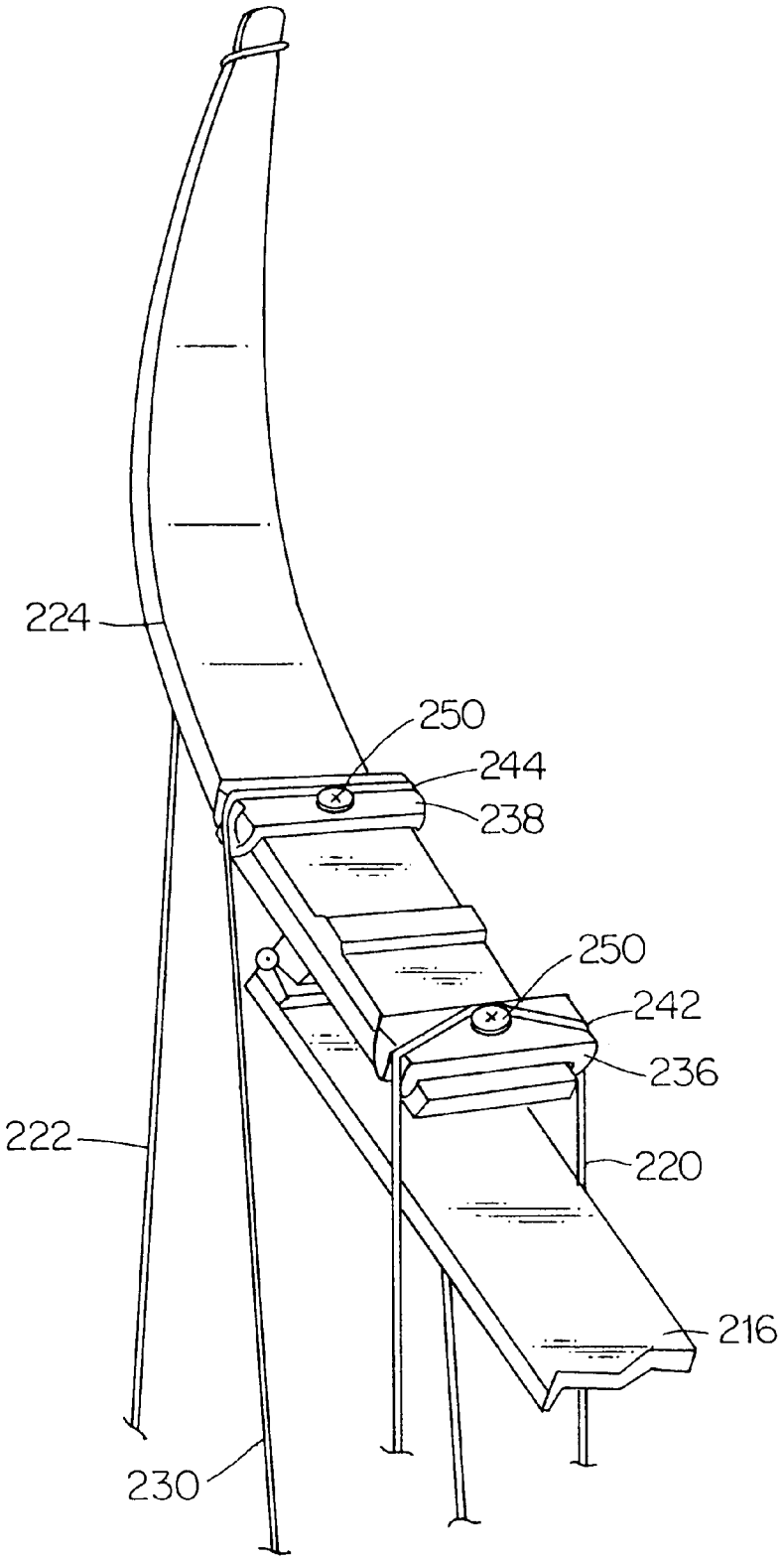
FIG. 11 is an enlarged top perspective view of the bow of FIGS. 8–10.

It will be readily apparent that certain modifications are possible. For example, and referring to FIGS. 8–11, a compound bow 200 in accordance with a second preferred embodiment of the present invention routs each of the camming cables 220, 230 over the outer bow limb 224 rather than over each of the outer bow limb and the power limb 216, as described in the preceding. The outer bow limb 224 according to this embodiment includes a pair of saddles 236, 238 mounted to the exterior side by suitable means, such as cable lock fasteners 250, each saddle having a groove 242, 244 appropriately sized for allowing a respective cam cable 220, 230 to be wound therethrough. Saddle 238 is preferably placed beyond the hinge point, that is further outboard of the hinge assembly 258 to allow significant flexion when the drawstring 222 is pulled, as shown in FIG. 10. The cams 246 according to this embodiment are each mounted outboard of the riser portion 212, as in the preceding design, but are suitably shaped to allow significant contact between each of the respective cam cables 220,230 and the cam grooves (not shown).

Figure 12:
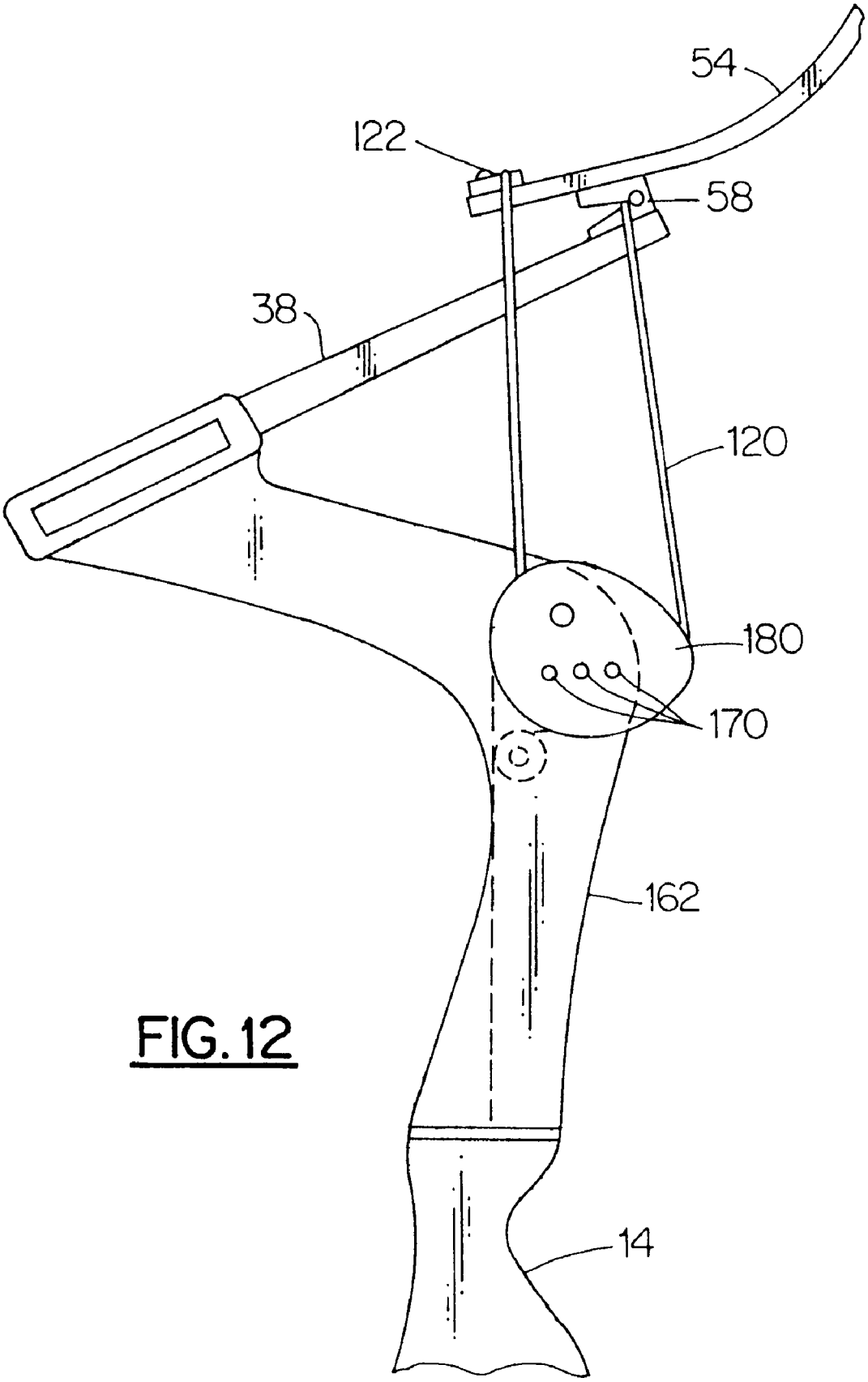
FIG. 12 is a partial perspective view of a compound bow according to a third embodiment of the present invention.

Other variations are possible using the concepts as described herein. For example, and referring to FIG. 12, a preferred example of an alternate riser design is illustrated. For the sake of clarity, similar parts are labeled with the same reference numerals. According to this embodiment, the pockets of the riser section 162 are tipped forward in a more pronounced reflex arrangement to better incorporate the use of the stanchion (not shown). The net result of this embodiment is that the profile of the riser section 162 can be more aesthetic, and perhaps more importantly, the grip of the riser is closer to the bow drawstring (not shown). That is, the brace height is reduced. The advantage of providing lower brace height is that the drawstring can be pulled farther, thereby increasing the power stroke and potential for storing energy and generating speed. As such, the cams can be directly attached to the riser itself. By making the cams larger (only cam 180 is visible), an increase in the amount of programming space is made available, allowing a number of alternative reeving points for either of cables 110, 120 using external slots 170.

PARTS LIST FOR FIGS. 1–12

10 compound bow
10A compound bow
12 riser section
12A riser section
13 front face
14 handgrip
15 reflexed portion
22 belly side
26 back side
30 top end portion
34 bottom end portion
35 front side—power limb
38 power limbs
37 back side—power limb
39 free ends—power limbs
42 base—power limb
46 weight adjustment screw
50 limb pocket
51 back side—outer limb
53 threaded fasteners
54 outer bow limb
58 hinge assembly
61 hinge plate
62 tip
63 hinge plate
65 common hinge pin
66 distal end
70 string nock
74 bowstring
80 synchronization pulley
84 idler wheel
88 timing cable
90 cam assembly
92 center stanchion
95 axle
96 ends
100 eccentric cam
104 eccentric cam
106 cam groove, inboard
107 groove
108 cam groove, outboard
110 cam cable
112 cable sleeve
116 radial slot
118 V-shaped groove
120 power cable
122 saddle
130 yoke
140 plate pylon
144 plate pylon
148 cavity
152 axle
156 cam
160 clevis block
162 riser section

164 clevis pin
168 direction
170 slots
180 oversized cam
200 compound bow
212 riser portion
216 power limbs
220 cam cable
222 drawstring
224 outer bow limbs
230 cam cable
236 saddle
238 saddle
242 groove
244 groove
246 cams
250 fasteners cable lock
258 hinge assembly
230 cam cable While this invention has been described in reference to the disclosure herein set forth, it is not necessarily limited to the above specific embodiments and this application is intended to cover any modifications and changes as covered by the appended claims.

What is claimed is:

1. A compound archery bow, comprising:

a riser section having a center portion and a pair of opposing ends;

a pair of flexible inner bow limbs, each of said inner bow limbs being cantilevered to a respective end of said riser section;

a pair of outer bow limbs, each of said outer bow limbs being hingably attached at an intermediate portion thereof to free standing ends of a corresponding inner bow limb;

a drawstring tautly attached at each end thereof to respective distal ends of said pair of outer bow limbs; and a cam assembly including two pairs of parallel cams, each pair of parallel cams being oppositely disposed relative to the center portion of said riser section and oppositely spaced outboard of the width thereof, and first and second camming cables associated with each said pair of parallel cams, each of said first and second camming cables extending along respective spaced paths extending between a pair of parallel cams and the width of one of said inner and outer bow limbs, wherein pulling of said drawstring causes coordinated rotation of said cams so as to cause lessening of the tension of said drawstring at an intermediate draw point.

2. A compound archery bow as recited in claim 1, including a hinge assembly interconnecting each pair of inner and outer bow limbs, said hinge assembly includes first cable retaining means for retaining a portion of one of said camming cables over the width of each inner bow limb.

3. A compound archery bow as recited in claim 2, wherein each first camming cable extends along a path defined between a first peripheral groove provided in each pair of parallel cams extending over the width of the outer bow limb and the second camming cable extends along a path defined between second peripheral grooves provided in each pair of parallel cams and extending over the width of one of said inner and outer bow limbs, each of said bow limbs having means disposed on an exterior side thereof for retaining each said camming cable, each of said retaining means being spaced from each other by a predetermined distance.

4. A compound bow as recited in claim 3, wherein each of said camming cables extend over the width of said outer bow limb, wherein said retaining means are located on opposite sides of said hinge assembly.

5. A compound bow as recited in claim 1, wherein the spacing between each cam in said pair of parallel cams is substantially equal to the width of said bow limbs.

6. A compound bow as recited in claim 1, including a pair of stanchions oppositely attached to respective reflexive portions of said riser section which are oppositely disposed relative to the center portion, each said stanchion including an axle having opposing ends to which each cam of said pair of parallel cams are attached, said cams being outboard of the width of said riser section and rotatable without interference therewith.

7. A compound bow as recited in claim 6, wherein said stanchions are integral to said riser section.

8. A compound bow as recited in claim 1, wherein each of said pair of parallel cams includes a plurality of reeving points for securing at least one end of said first and second camming cables, said reeving points being disposed on an exterior surface of said cams.

9. A compound bow as recited in claim 1, in which each of said of pair of parallel cams include an exterior surface having at least one alternative reeving site for at least one of said first and said second camming cables.

10. A compound bow as recited in claim 1, wherein said riser section includes a reflexed portion extending toward said drawstring, said reflexed portion including means for mounting said parallel cams to opposing sides thereof.

* * * * *